United States Patent [19]

Brochu

[11] 4,447,922

[45] May 15, 1984

[54] PILLOW APPARATUS

[76] Inventor: Henry D. Brochu, 4075 N. Tyndall Ave., Tucson, Ariz. 85719

[21] Appl. No.: 341,879

[22] Filed: Jan. 22, 1982

[51] Int. Cl.[3] ..... A47G 9/00

[52] U.S. Cl. ..... 5/434; 5/437; 297/250; 297/391; 297/423

[58] Field of Search ..... 5/434, 435, 436, 437, 5/441, 443, 444; D6/201-204; 297/220, 391, 250, 423

[56] References Cited

U.S. PATENT DOCUMENTS

| | | | |
|---|---|---|---|
| D. 214,302 | 6/1969 | Barber | 5/434 |
| 3,347,544 | 10/1967 | Uffenorde | 5/434 |
| 3,578,383 | 5/1971 | Thad | 5/434 |
| 3,694,831 | 10/1972 | Treace | 5/435 |
| 3,946,451 | 3/1976 | Spann | 5/443 |
| 4,074,373 | 2/1978 | Garofald | 5/434 |

FOREIGN PATENT DOCUMENTS

| | | | |
|---|---|---|---|
| 641616 | 1/1964 | Belgium | 5/436 |

*Primary Examiner*—Alexander Grosz
*Attorney, Agent, or Firm*—H. Gordon Shields

[57] ABSTRACT

Pillow apparatus includes a centrally disposed slot extending axially through a pillow which receives a user's head and a relieved portion beneath the slot, on the bottom of the pillow.

3 Claims, 5 Drawing Figures

PILLOW APPARATUS

BACKGROUND OF THE INVENTION

1. Field of the Invention

This invention relates to pillows, and, more particularly, to pillow apparatus used to hold a user's head in a relatively fixed position and to support it upwardly and laterally by a pair of sides.

2. Description of the Prior Art

Pillows are generally used to provide a comfortable reclining support for a user's head. Some pillows are designed to give specific support or to support the user's head in a certain way. Some pillows are designed for purely aesthetic purposes, and some pillows are designed for a combination of aesthetic and utilitarian purposes. Some pillows are designed to be usable in more than one manner, thus combining different types of utilitarian functions in a single element.

U.S. Pat. No. Des. 237,569 discloses a pillow which is usuable in two different ways. The pillow includes a pair of conical protrusions extending upwardly from a front pillow surface and between which a user's head may be disposed. The conical protrusion provides support for the user's head. By turning the '569 pillow around, using the protrusions and one edge of a pillow as a support, the other side, rearwardly of the protrusions and relatively flat, provides an upwardly extending pillow. By inverting the manner in which the protrusions support the pillow, two different angular orientations of the relatively flat side are provided.

U.S. Pat. No. 1,385,355 discloses a pillow fabricated in three portions. The three portions include a center portion disposed between two outer portions. The configurations of the three portions may be varied, depending on the particular use to which the pillow apparatus will be applied. Regardless of the particular configuration, the center portion is substantially smaller than the two outer portions. The outer portions are generally identical to each other, or comprise mirror images of each other.

U.S. Pat. No. 2,765,480 discloses another type of pillow which has two outer portions and an inner portion. The inner portion in the '480 pillow is a connecting web which extends between the two outer portions. The '480 pillow is used primarily as a back rest or, folded, as a seat and back rest.

U.S. Pat. No. 2,952,856 discloses pillow apparatus which resembles, in general, the apparatus of the '480 patent. It discloses a pair of pillows spaced apart by, or secured to, a central web. The outer pillows are rounded cushions, as opposed to the generally flatter or more squatty outer elements of the '480 patent.

U.S. Pat. 1,967,067 discloses a head protector type apparatus which may be used in conjunction with a pillow. A user places the apparatus of the '067 patent around the user's head when the user's head is disposed on a pillow. The purpose of the apparatus of the '067 patent is to protect the user's head from drafts, etc. It is configured generally as a "U" with a center connecting web to hold the "U" shaped elements together.

U.S. Pat. No. 2,167,622 discloses a pillow having two spaced apart portions separated by a center portion which receives the head of the user. The configuration of the two outer portions and the center portions are designed to provide support for the head and neck of the user.

U.S. Pat. No. 2,877,472 discloses a pillow having three separate portions, each of which is of a different size. When the three portions are folded, the exterior appearance of the apparatus, from the side, describes a triangle, the user determines which of the legs of the triangle is to be used, and in what manner. Since each of the three portions is of a different size, folding the pillow into the triangular shape allows the user to select any of the three resulting surfaces for a particular use.

U.S. Pat. No. 3,327,330 discloses a comfort pillow which is of a configuration of a relatively wide "Z" and which may be folded as desired by the user. The purpose of the '330 patent is to hold the head of the user in a particular manner. The holding is accomplished by folding portions of the pillow, as desired.

U.S. Pat. No. 3,243,828 discloses a cervical pillow which is made with several different portions and with slots in the apparatus for receiving inserts. The inserts make either the center or the side portions higher or lower, as desired by the user, and in accordance with the requirements of the user's head and neck, or in accordance with the size, etc., of the user.

U.S. Pat. No. 3,347,544 discloses a pillow or head rest which includes a clamping screen. The apparatus is designed to hold a person's head for eye surgery. The '544 pillow is designed to be draped over a chair and to hold a person's head while the person is reclining in the chair and against the pillow. The pillow apparatus includes two convex or cushion portions with a relatively flat connecting portion between the two pillows. A second connecting portion extends at the top of the pillow and is the same height as the side portions, so that the flat area comprises a limited area for receiving the user's head.

U.S. Pat. No. 4,042,278 describes a pillow unit which is adapted to be draped over the top of a chair to enable the user's head to rest against the pillow for relaxing. The pillow is of a generally rectangular configuration with four spaced-apart convex or cushion portions arranged generally parallel to the longer sides of the apparatus and at the corners of the apparatus.

U.S. Pat. No. 4,206,945 discloses a pillow usable for the back of a chair. The '945 pillow apparatus includes convex portions spaced apart from each other and adapted to hold the head or neck of the user between the convex portions.

U.S. Pat. No. 4,274,673 discloses a pair of inflatable convex elements separated by a connecting portion. The '673 apparatus is usable in several different ways.

U.S. Pat. No. 4,285,081 discloses a support pillow for supporting the head and neck of a user. It includes a pair of upwardly extending elements and a lower, cushion element between the two upwardly extending portions. The concavity between the upwardly extending portions receives the neck and back of the lower head of the individual.

SUMMARY OF THE INVENTION

The invention described and claimed herein comprises a pillow apparatus having two vertically upwardly extending elements and a connecting portion between the upwardly extending elements, the connecting portion is spaced upwardly from the bottom of the upwardly extending elements such that when a user's head is disposed on the connecting pillow portion, the connecting portion moves downwardly under the weight of the user's head and neck and the upwardly extending portions pivot inwardly to hold the user's head and to provide a noise cushioning effect on the user's head. Alternately, the pillow apparatus may be used as a seat for supporting and holding a child.

Among the objects of the present invention are the following:

To provide new and useful pillow apparatus;

To provide new and useful pillow apparatus for holding and positioning a user's head;

To provide new and useful apparatus for supporting a user's head in a relatively fixed manner.

To provide new and useful pillow apparatus for supporting and holding a child;

To provide new and useful pillow apparatus for dampening sounds; and

To provide new and useful pillow apparatus for cushioning a user's head.

DESCRIPTION OF THE PREFERRED EMBODIMENT

Figure 1:
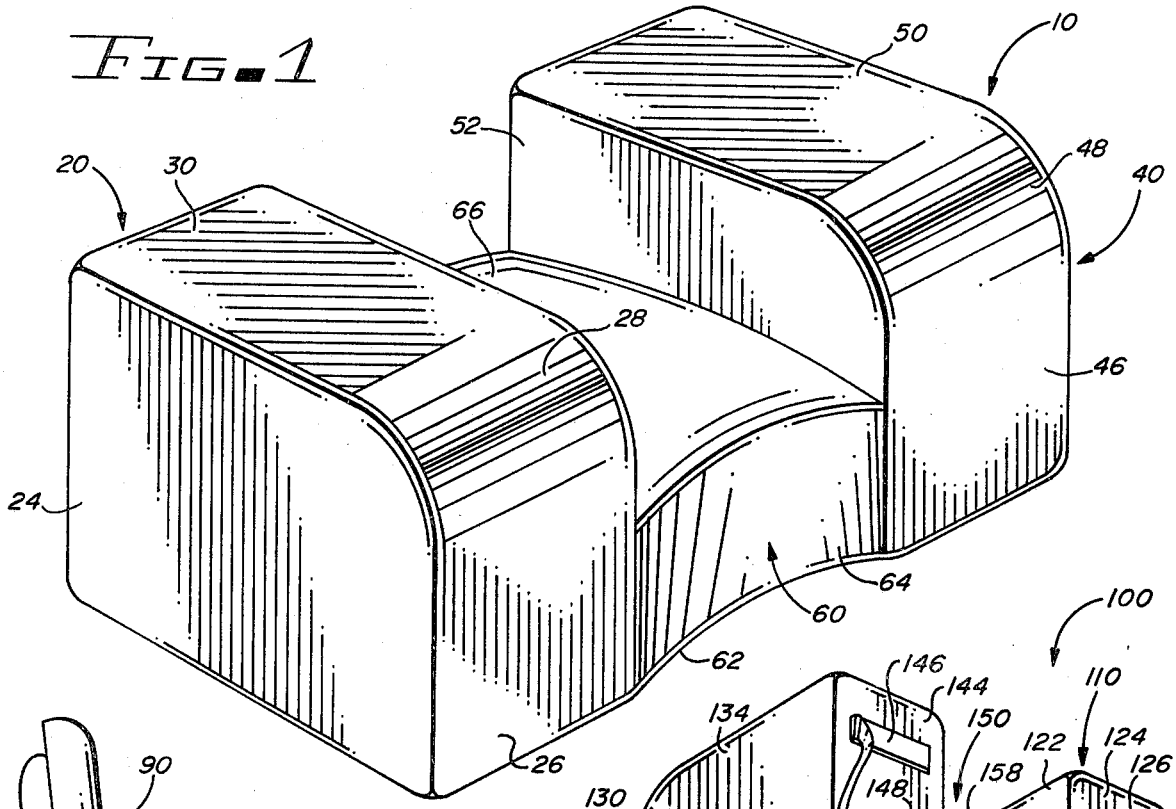
FIG. 1 comprises a perspective view of the apparatus of the present invention.
Figure 2:
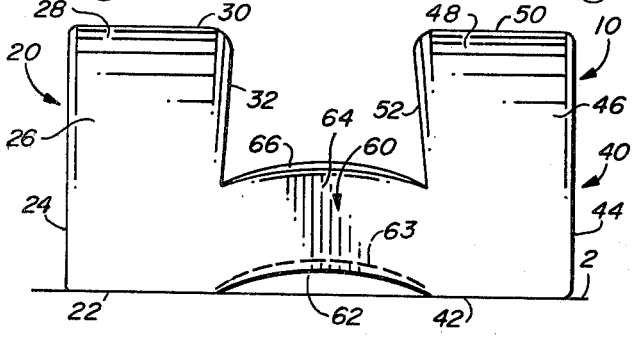
FIG. 2 comprises a front elevational view of the apparatus of FIG. 1.
Figure 3:
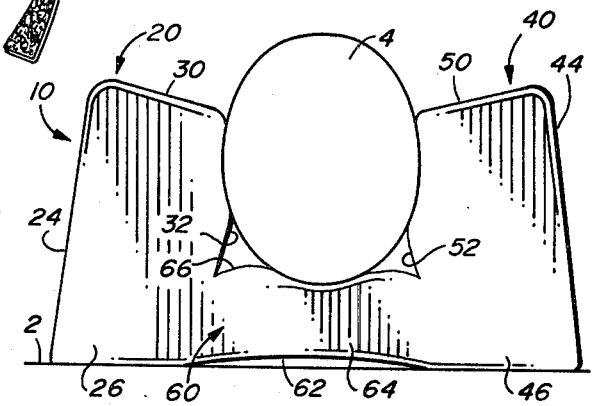
FIG. 3 is a front elevational view of the apparatus of FIG. 2, with a human head illustratively disposed within the pillow apparatus.

FIG. 1 is an upper front right perspective view of pillow apparatus 10 of the present invention. FIG. 2 is a front elevational view of the pillow apparatus 10 of FIG. 1, with the pillow apparatus 10 disposed on a platform 2, which may be a bed, a table, or the like. FIG. 3 is a view of the pillow apparatus 10 similar to that of FIG. 2, but with a human head 4 schematically shown disposed within the pillow apparatus 10 to illustrate the functioning of the pillow apparatus 10 in holding the head 4. For the following discussion, reference will primarily be made in FIGS. 1, 2, and 3.

The pillow apparatus 10 includes three separate portions, including a pair of vertically extending wings 20 and 40 spaced apart and separated by a central portion 60. The wings are substantially identical in configuration. The center portion 60 is a connecting portion between the two outer wing portions 20 and 40.

The wing 20 includes a bottom 22 which, as shown in FIGS. 2 and 3, is disposed on a platform 2, which may be a bed, if the pillow apparatus 10 is used on a bed, or the platform 2 may be a gurney or an operating table, if the pillow apparatus is used as a surgical pillow block, as will be discussed below.

Extending upwardly substantially perpendicular to the bottom 22 is an outer side 24. A front side 26 extends substantially perpendicularly to both the bottom 22 and the outer side 24. At the upper portion of the front side 26 is a rounded corner or edge which comprises a transitional portion between the front side 26 and a top side 30. Extending downwardly from the outside 30, and connected also to the front side 26, is a sloping inner side 32. The inner side 32 extends downwardly and inwardly from the top side 30. The width of the wing element 20, the distance between the outer side 24 and the inner side 22 may be as desired, depending on the purpose of the pillow apparatus, the density of the material out of which it is made, its overall size, etc.

The wing 40, disposed oppositely from the wing 20, is substantially identical to the wing 20. It includes a bottom 42 which is substantially aligned with, and on the same plane as, the bottom 22. An outer side 44 extends upwardly substantially perpendicularly to the bottom 42. The front side 46 extends upwardly also substantially perpendicularly to the bottom 42 and is connected to the outer side 44 substantially perpendicularly to the bottom 42 and is connected to the outer side 44 substantially perpendicularly thereto, in the same manner as the front side 26 relates to both the bottom 22 and the outer side 24. At the upper portion of the front side 46 is a rounded corner or edge 48 which comprises a transitional portion between the front side 26 and a top 50. The top surface 50 may be parallel to the bottom surface 42, as may the top surface 30 with respect to the bottom surface 22 of the wing 20.

Extending downwardly and inwardly from the top 50 is an inner side 52. The inner side 52 is not parallel to the inner side 32 of the wing 20, or to the outer side 44. Rather, the upper portion of the pillow apparatus 20, where the inner sides 32 and 52 join with the top sides 30 and 50, respectively, the spacing is less between the inner sides 32 and 52 than at the lower portion of the sides, where the sides 32 and 52 join to the center portion 60. The inner side 52 thus has a slight taper downwardly and inwardly, or away from the center portion.

The center portion 60 extends between the wings 20 and 40 generally at the lower part of the wings, providing a space above the center portion 60 and between the wings in which a user's head 4, as shown in FIG. 3, may be disposed.

At the bottom of the center portion 60 is a bottom, concave arch 62. The arch 62 extends in three dimensions between the bottom surfaces 22 and 42 of the wings. As shown in FIGS. 2 and 3, the bottom arch 62 extends upwardly from the inner portions of the bottom side 22 and forwardly. However, the arch 62 also extends upwardly between the front and rear of the pillow apparatus 10, as indicated in dotted line in FIG. 2 by reference numeral 63. The dotted line 63 signifies the maximum height or extent of the arch 62.

The center portion 60 includes a front surface 64 which is generally of a concave configuration, extending rearwardly from the adjacent portions of the front surfaces 26 and 46 of the wings 20 and 40, respectively. The front surface 64 also slopes, as will be discussed below.

Extending on the top of the center portion 60 is a top arch 66. The top arch 66 defines a compound curve of a generally convex configuration between the adjacent portions of the inner sides 32 and 52 and between the front surface 64 and a rear surface (not shown). It will be noted that the front surface 64 extends downwardly and slightly rearwardly from the front portion of the top arch 66 to the front portion of the bottom arch 62.

The pillow apparatus 10 is preferably made of foam material. The resiliency of the foam material may vary, according to the particular use for which the pillow apparatus is designed or to which it will be put. That is, the resiliency may vary from pillow to pillow, depending on the particular use for which the pillow is designed. If the pillow apparatus is too stiff, and accordingly not very resilient, the pillow apparatus may not appropriately move or conform to the user's head. If the pillow is too resilient, its movement may be on the order of a floppy element, without the desired conformation.

When a user's head 4 is disposed on the surface of the top arch 66, the weight of the head 4 causes the center section 60 to move downwardly, thus decreasing the height of the bottom arch 62. At the same time, the user's head extends downwardly into the center portion 60, providing a concavity in the center portion in which the head is disposed.

When the center portion 66 moves downwardly under the weight of the user's head 4, with the attendant lowering of the bottom arch 62, the wings 20 and 40 pivot inwardly against the sides of the head 4. The inner sides 32 and 52 of the wings 20 and 40 contact the sides of the user's head 4 for whatever purpose is desired. That is, if the pillow apparatus 10 is to be used as a surgical block, to immobolize the head 4 for surgical purposes, the inner sides 32 and 52 press against the head 4 to immobolize the head. With the wings 20 and 40 made of foam material of various resiliencies, different effects may be accomplished. For example, if the pillow apparatus 10 is to be used to help drown out noise, as for a day sleeper, the pillow material may be more resilient than if the pillow apparatus 10 is to be used as a surgical pillow block.

While the pillow apparatus 10 may be made of a single piece of foam material, it is obvious that the pillow apparatus 10 may be made of different pieces, with all pieces having the same resiliency or having different resiliency. For example, the resiliency of the center portion 60, on which the user's head rests, may be of a different resiliency from the wings 20 and 40. For manufacturing purposes, it may be more efficient to make the pillow apparatus 10 out of three separate pieces, a piece for one wing, a piece for the other portion, and a piece for the other wing, than to fabricate the pillow from a single piece. The elements or peices may then be appropriately secured together. The apparatus may be molded, also, if desired.

The pillow apparatus 10 may also be fabricated in different sizes, depending on the particular use or size of the individual for whom the apparatus is to be made.

Figure 5:
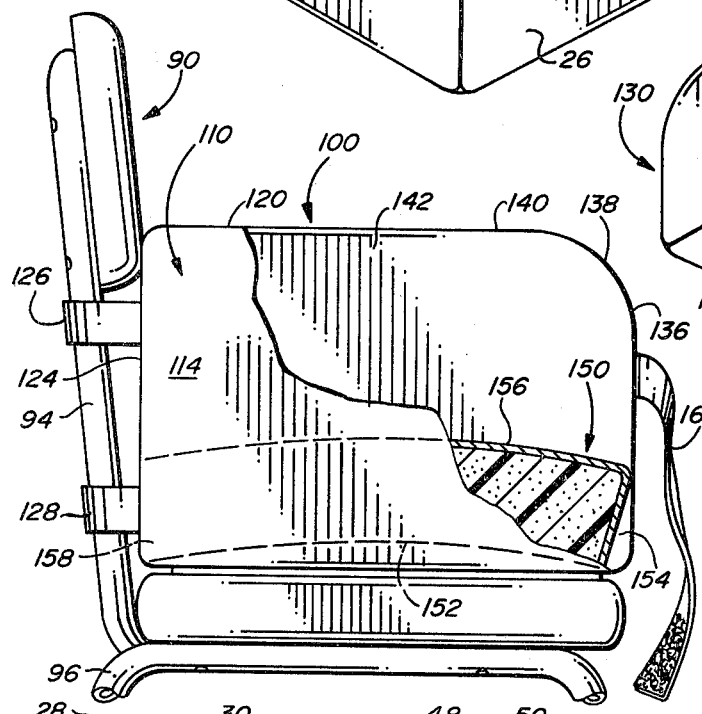
FIG. 5 is a side view, with a portion broken away, illustrating the use environment of the apparatus of FIG. 4.
Figure 4:
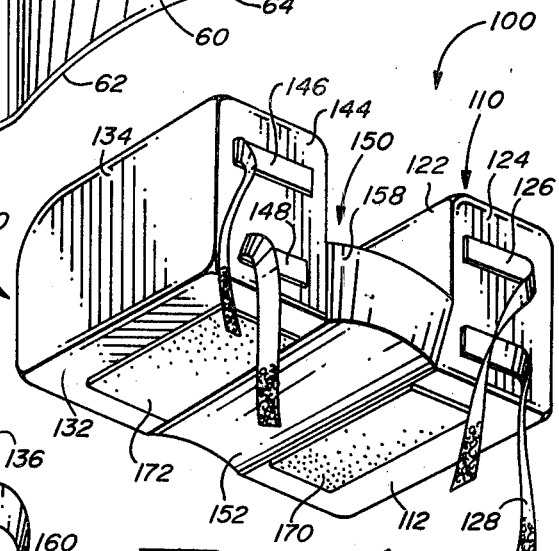
FIG. 4 is a lower left rear perspective view of an alternate embodiment of the apparatus of the present invention.

FIGS. 4 and 5 comprise an alternate embodiment of the pillow apparatus 10 in FIGS. 1, 2, and 3. In FIGS. 4 and 5, a pillow 100 is shown used as a seat for an infant or for a young person. The pillow apparatus 100 in FIGS. 4 and 5 is used in conjunction with a chair 90. FIG. 4 comprises a lower left rear perspective view of pillow apparatus 100. FIG. 5 is a side view, with a portion removed, of the pillow apparatus 100, showing the pillow apparatus 100 secured to the chair 90. For the following discussion, reference will be made to FIGS. 4 and 5.

The pillow apparatus 100 of FIGS. 4 and 5 is substantially identical in overall design to the pillow apparatus 10 of FIGS. 1, 2, and 3. The pillow apparatus 100 includes a wing 110 and a wing 130, spaced apart from each other, and connected together by a center portion 150. The primary differences between the pillow apparatus 100 and the pillow apparatus 10 are the inclusion with the pillow apparatus 100 of straps for securing the pillow 100 to a chair, non-slip pads 170 and 172, and possibly the resiliency of the material out of which the pillow apparatus 100 is made. These features will be discussed in detail below.

The wing 110 includes a bottom 112 which is generally flat, or planar. The wing 110 also includes an outer side 114 extending upwardly substantially perpendicular to the bottom 112. The wing 110 also includes a top side 120 which is generally parallel to the bottom side 112 and substantially perpendicular to the outer side 114. Like the corresponding wing 20 of the pillow apparatus 10, the wing 110 includes a front side and a rounded corner or transition portion between the front side and the top side 120. However, the front side and its rounded corner are not shown for the wing 110.

An inner side 122 extends downwardly and inwardly from the top 120. The inner side 122 terminates at the juncture of the wing 110 and the center portion 150. Thus, the width of the wing 110, due to the slopping angle of the inner side 122, has a width greater at the top 120 than at the juncture of the wing 110 with the center portion 150. This is substantially identical to the configuration for the pillow 10 as best shown in FIG. 2.

A back 124 of the wing 110 extends between the outer side 114 and the inner side 122 and between the top side 120 and the bottom side 112. The back 124 is generally flat or planar. Secured to the back 124 are a pair of fastening straps 126 and 128. At the free ends of the straps 126 and 128 may be appropriate means for fastening the straps to another pair of straps 146 and 148 secured to the wing 130, and discussed below Material such as "Velcro" fastener material may be used for securing the straps together.

The wing 130 is substantially identical to the wing 110, and comprises a virtual mirror image thereof. The wing 130 includes a bottom 132 which is generally flat, and aligned on a common plane with the bottom 112 of the wing 110. An outer side 134 extends upwardly from the bottom 132. A front side 136 extends upwardly from the bottom 132, and is connected to both the outer side 134 and the bottom 132. The front side 136 includes an upper rounded corner 138, remote from the bottom 132. The rounded corner 138 defines a transition area between the front side 136 and a top side 140. The top side 140 is substantially parallel to the bottom side 132. Extending downwardly and sloping inwardly form the top side 140 is an inner side 142. The inner side 142 extends downwardly from the top side 140 to the center portion 150.

The wing 130 includes a back 144, which is generally flat and aligned with the back 124 of the wing 110. A pair of straps 146 and 148 are appropriately secured to the back 144. The free ends of the straps 146 and 148 include appropriate fastening means, such as "Velcro" fastener material, to allow the opposite pairs of straps 126, 146, and 128, 148, to be appropriately secured together to secure the pillow apparatus 100 to the chair 90, as shown in FIG. 5.

The center portion 150 extends between the wings 110 and 130 at the lower part of the wings. The center portion includes a bottom arch 152 which extends longitudinally with respect to the pillow apparatus 100 between the front portion and rear portion of the apparatus. The center portion 152 also includes a top arch 156, which is generally convex, while the bottom arch 152 is generally concave.

As best shown in FIG. 5, the arches 152 and 156 are compound arches in that they are concave and convex, respectively, in two directions. This has been discussed above, in conjunction with FIG. 2, for the pillow apparatus 10, and may also be visualized in FIG. 5.

Also included in the center portion 150 is a front side 154 and a back side 158. The downward and inward slope of both the front side 154 and the back side 158, as well as the concavity of both sides, may be understood or visualized from FIG. 5. The configuration of the arches 62 and 66 of the pillow 10 shown in FIGS. 1, 2, and 3 is substantially identical to the configuration of the arches 152 and 156 of the embodiment of FIGS. 4 and 5. FIGS. 4 and 5 may accordingly appropriatelv be veiwed in conjunction with the discussion of the arches 62 and 66 of FIGS. 1, 2, and 3.

Secured to the bottom sides 112 and 132 of the wings 110 and 130 are a pair of non-skid or non-slip pads 170 and 172, respectively. The pads 170 and 172 aid the pillow 100 in maintaining its position on a chair regardless of the movements of the child using the pillow 100.

FIG. 5 illustrates the use environment of the pillow apparatus 100 as a seat for an infant or young child. The chair 90 includes a seat portion 92 and a back portion 94, both of which are secured to a leg portion 96. The bottom of the pillow apparatus 100, namely the bottom sides 112 and 132, with their non-slip pads 170 and 172, respectively, are disposed on the seat 92. The straps 126, 146, and 128, 148 are used to secure the seat 100 to the chair 90 by securing the straps around the back 94. At least a single additional strap 160, or perhaps another additional strap, not shown, may be secured to the pillow apparatus 100 to be used as a safety belt to fasten a child into the pillow seat apparatus 100. It will be noted that, while the proportions of the pillow 100 are shown as having substantially the same proportions as the pillow apparatus 10, the width of the wings 110 and 130, or the distance between the outer sides and the inner sides, may be reduced, as required, for using the pillow 100 as a seat for an infant. Furthermore, the density of the material out of which the pillow 100 is made may be different from the density of the foam material for the pillow apparatus 10. However, the concept of the use of the pillow apparatus 100 is substantially the same as the concept of the use of the pillow apparatus 10, with a child's body disposed on the center portion 150 rather than the head of an individual.

As a child is placed on the top arch 156 of the pillow 100, the weight of the child's body causes the center portion 150 to move downwardly. This in turn causes the wings 110 and 150 to pivot inwardly, thus providing side support for the infant to help hold the infant within the pillow/seat 100, and thus secure the infant to the chair 90.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. A resilient pillow apparatus, comprising, in combination:

first wing means having a first top surface and a first bottom surface;

second wing means spaced apart from the first wing means and having a second top surface and a second bottom surface;

center means disposed between and secured to the first and second wing means and having a bottom compound concave arch extending upwardly between the first and second wing means and above the first and second bottom surfaces to allow the center means to move downwardly under the weight of a user on the center means, said center means being disposed downwardly from the first and second top surfaces, the first wing means further including a first inner side extending downwardly from the first top surface to the center means, the second wing means further including a second inner side extending downwardly from the second top surface to the center means, the center means further including a convex top arch extending between the first and second inner sides of the first and second wings, respectively, whereby the first and second wing means move inwardly under the weight of a user with the first and second inner sides disposed against the user on the center means.

2. The apparatus of claim 1 in which the convex top arch is compound convex in configuration.

3. The apparatus of claim 1 in which both the first inner side and the second inner side extend downwardly and inwardly from their respective tops to provide inwardly sloping sides.

* * * * *